US008245905B2

(12) United States Patent
Lantz et al.

(10) Patent No.: US 8,245,905 B2
(45) Date of Patent: Aug. 21, 2012

(54) LOCKING BALLOT RECEPTACLE

(76) Inventors: Paul D. Lantz, Kingston, PA (US); Robert J. Cohn, Dallas, PA (US)

( * ) Notice: Subject to any disclaimer, the term of this patent is extended or adjusted under 35 U.S.C. 154(b) by 0 days.

(21) Appl. No.: 12/365,105

(22) Filed: Feb. 3, 2009

(65) Prior Publication Data

US 2009/0206150 A1 Aug. 20, 2009

Related U.S. Application Data

(60) Provisional application No. 61/029,330, filed on Feb. 16, 2008.

(51) Int. Cl.
*G07C 13/02* (2006.01)

(52) U.S. Cl. ..... 232/2; 232/44; 220/345.2; 206/807

(58) Field of Classification Search ..... 232/2, 44, 232/1 D; 206/807; 220/214, 253, 254.9, 220/259.5, 345.1, 345.2
See application file for complete search history.

(56) References Cited

U.S. PATENT DOCUMENTS

| | | | | | |
|---|---|---|---|---|---|
| 154,148 | A | * | 8/1874 | Omensetter et al. | 232/2 |
| 1,275,579 | A | * | 8/1918 | McGowan | 232/2 |
| 1,545,435 | A | * | 7/1925 | McFarland | 232/2 |
| 1,673,769 | A | * | 6/1928 | Graham | 220/6 |
| 1,821,710 | A | * | 9/1931 | Holbert | 232/2 |
| 2,437,584 | A | * | 3/1948 | Zamora | 232/2 |
| 5,681,113 | A | * | 10/1997 | Rifkin et al. | 383/5 |
| 7,395,956 | B1 | * | 7/2008 | Bell et al. | 232/2 |

FOREIGN PATENT DOCUMENTS

GB 2355233 A * 4/2001

* cited by examiner

*Primary Examiner* — William L. Miller
(74) *Attorney, Agent, or Firm* — Bradley N. Ruben

(57) ABSTRACT

A ballot receptacle is provided with frame having an opening through which ballots are deposited into a receptacle and a sliding closure cooperating with the frame to seal the opening. A tamper evident seal is used to lock the closure in a sealed arrangement and thereby secure the ballots in the receptacle.

25 Claims, 6 Drawing Sheets

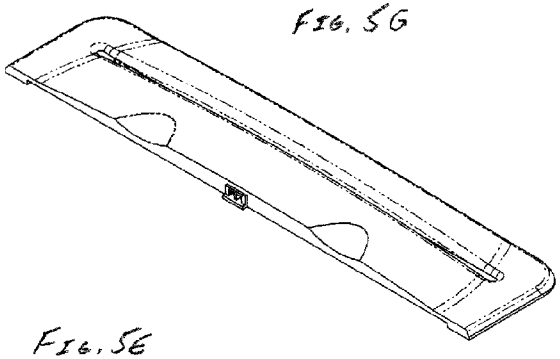
FIG. 5G
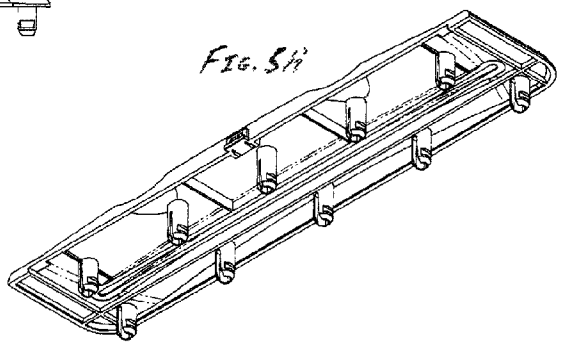
FIG. 5H
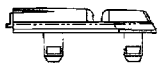
FIG. 5E
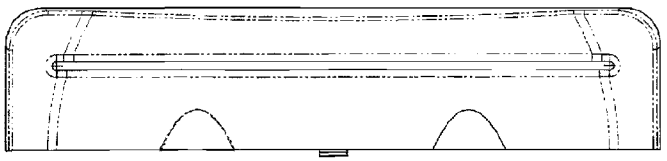
FIG. 5A
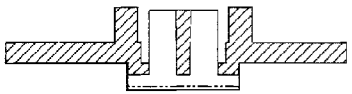
FIG. 5D
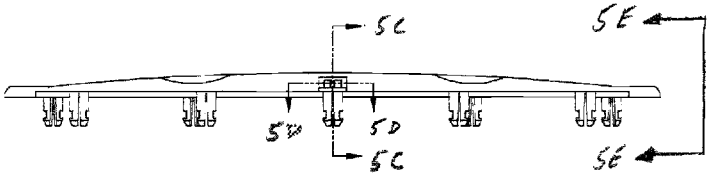
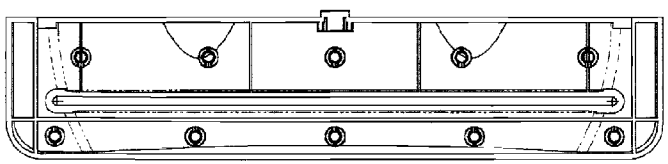
FIG. 5F
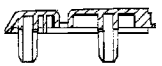
FIG. 5C

LOCKING BALLOT RECEPTACLE

RELATED APPLICATIONS

This application is based on U.S. 61/029,330, filed 16 Feb. 2008, the entirety of which is incorporated herein by reference.

BACKGROUND OF THE INVENTION

This invention is in the field of ballot receptacles having slots and to devices for securing such slots.

A ballot is typically a paper sheet or card used to cast or register a vote, usually a secret one. While a receptacle in accordance with the invention is adapted to receive and store ballots, it is also useable as a depository for sheets or cards that are not ballots, but are completed survey forms or other filled out forms that must be collected, or any sort of identification or token used as a marker for making a choice.

For example, when a survey is conducted in a shopping mall in which a large number of shoppers are questioned regarding their preferences or objections to certain products, the responses of each shopper are entered on a survey form. There is a need therefore for a receptacle in which to deposit for safekeeping the filled-out forms to be sure that the survey is accurate and has not been tampered with.

A conventional ballot box receptacle is made of metal, wood, plastic, or other rigid material and is provided with a locked hinged cover having an entry slot therein to receive ballots, one at a time. One problem with a conventional ballot box is that it is possible to shake out the deposited ballots through the entry slot, particularly if it is wide relative to the thickness of the ballot sheet, card, or token. Hence unauthorized personnel may be able to tamper with the vote or with whatever use to which the ballots are put.

To prevent such tampering, U.S. Pat. No. 1,673,769 discloses a ballot box whose locked hinged cover has an entry slot therein, and a closure mounted on the underside of the entry slot. The closure takes the form of a pivoted plate that is weighted at one end so that the plate normally lies against the slot and is swung open only by a ballot inserted in the slot to admit the ballot into the box. But one cannot shake a deposited ballot out of the box, for then the entry slot is blocked by the plate.

The concern of the present invention is especially with ballot pouches fabricated of leather, fabric or other flexible material, for these are more easily carried and transported to and from a polling place than a rigid ballot box. Thus U.S. Pat. No. 806,050 shows a ballot pouch that includes a bag of flexible material such as leather or canvas having a rigid cover disc provided with an entry slot. To prevent tampering with the pouch, a spring-biased, hinged flap is mounted below the entry slot so that the flap is swung open by an inserted ballot. But once a ballot is deposited in the pouch, it is then blocked by the closed flap and cannot be withdrawn from the pouch through the entry slot. U.S. Pat. No. 5,681,113 discloses a ballot pouch having a chute defined by a weighted bag associated with the slot to prevent ballots in the pouch from passing out the slot.

Electronic voting boxes, like in U.S. Pat. No. 5,610,383, can include an electronic card reader and have a locked rear door to prevent removal of the ballots, but nothing prevents ballots from being inserted after balloting has ended (or to allege later that the electronic reader was faulty). Alternatively, U.S. Pat. No. 4,981,259 discloses a ballot box having an auxiliary slotted compartment for accepting ballots when the electronic device is inoperative.

Generally, devices such as described in U.S. Pat. Nos. 6,279,822 and 6,648,144, include some sort of door for access to the slot or the ballot area that is locked in place.

GB-A 2,064,638 and GB-A 2,355,233 describe tamper evident seals for zippered openings and for locks.

Another problem with ballot receptacles is that, even if locked, it is possible for an unscrupulous person to remove (pick) or break the lock, tamper with the ballots, or add or remove ballots, and then to replace the lock without anyone the wiser.

SUMMARY OF THE INVENTION

In light of the foregoing, an object of this invention is to provide a lock for a voting slot that evidences tampering, and especially re-opening of the slot. Another object of this invention is to provide a lock that is easy to use. Yet another object of this invention is to further deter tampering by having indicia on the lock so that replacement of the lock (i.e., tampering) is impeded.

In summary, in one embodiment, this invention provides a ballot receptacle having a slot, a closure for the slot, and a tamper evident seal for the closure. In other embodiments, the receptacle can be a bag or a box. In still other embodiments, the seal has unique indicia so that replacement with another seal shows tampering.

BRIEF DESCRIPTION OF THE FIGURES

FIGS. 3A-G, 4A-G, and 5A-H depict further embodiments and views of the device described below with reference to FIGS. 1 and 2.

DETAILED DESCRIPTION OF SPECIFIC EMBODIMENTS

While described with respect to a ballot bag, it will be appreciated that the instant invention can be used to secure a slot in any structure, including a box, wall, or floor.

Figure 1A:
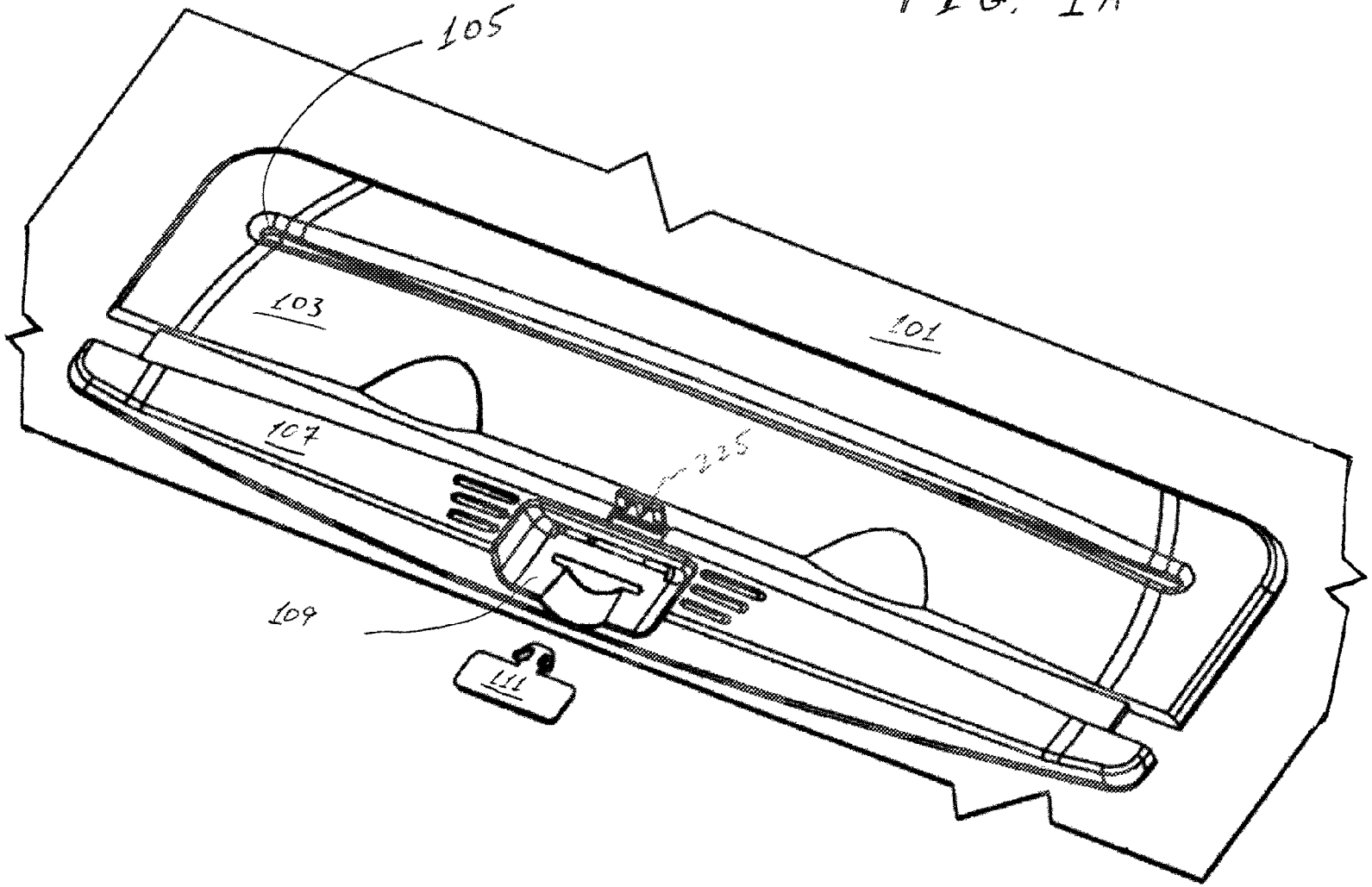
FIG. 1 is a partial top perspective view of a locked slot according to this invention.
Figure 18:
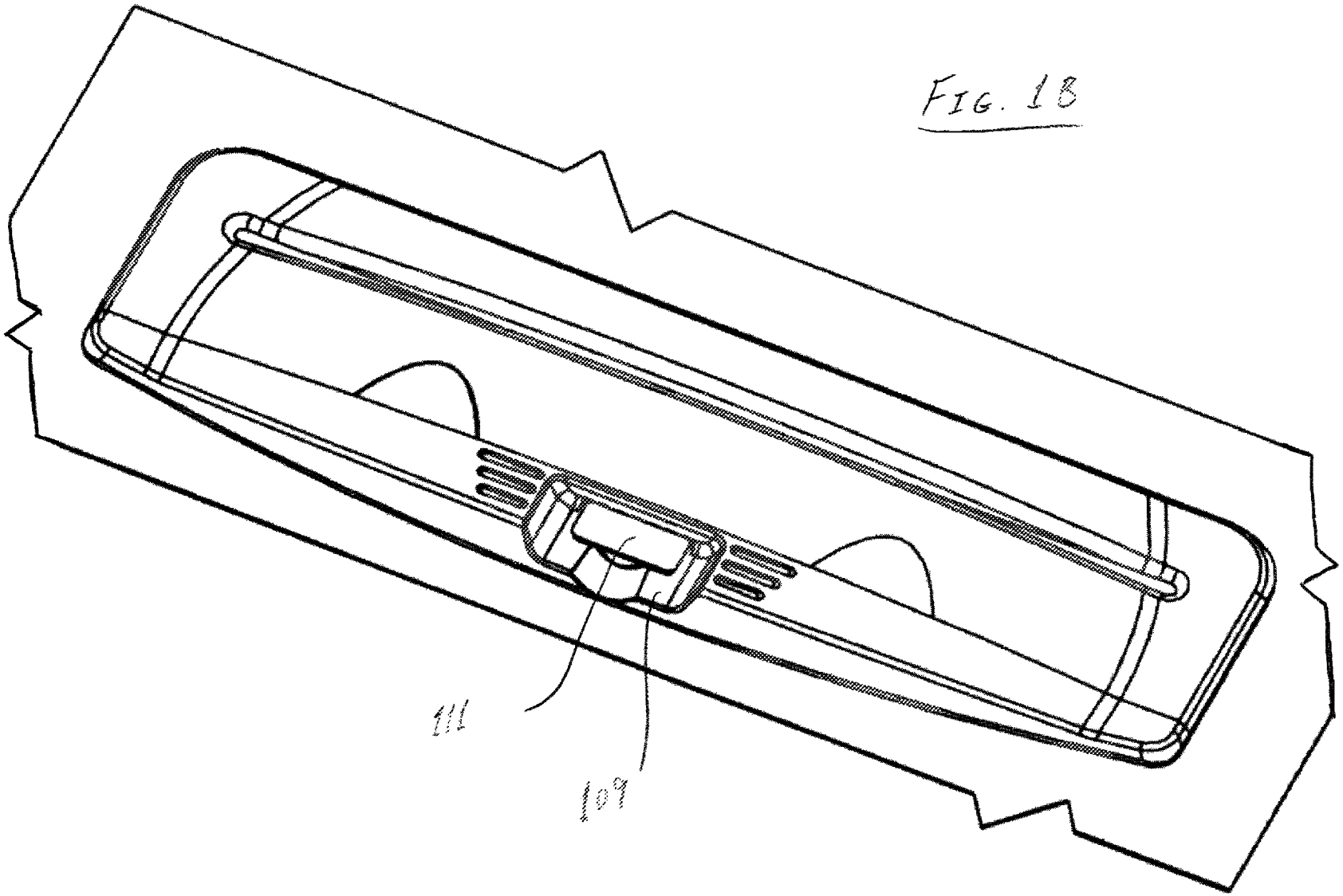

FIG. 1 is a perspective view of the slot portion of a ballot bag or pouch according to this invention in the locked position. More particularly, a flexible bag or pouch 101, typically made of leather or synthetic fiber or sheet, is provided with an opening. Disposed over the opening is a frame 103 having a slot 105 that cooperates with the opening in the bag to create the slot through which ballots (or tokens or the like, which are intended to be encompassed by the term ballots) are inserted into the bag. A closure 107 is shown cooperating with frame, and includes a flange that blocks (closes) the slot, as shown in other figures and described below. The closure includes a recess 109 through which a seal 111 secures the closure to the frame.

Figure 2:
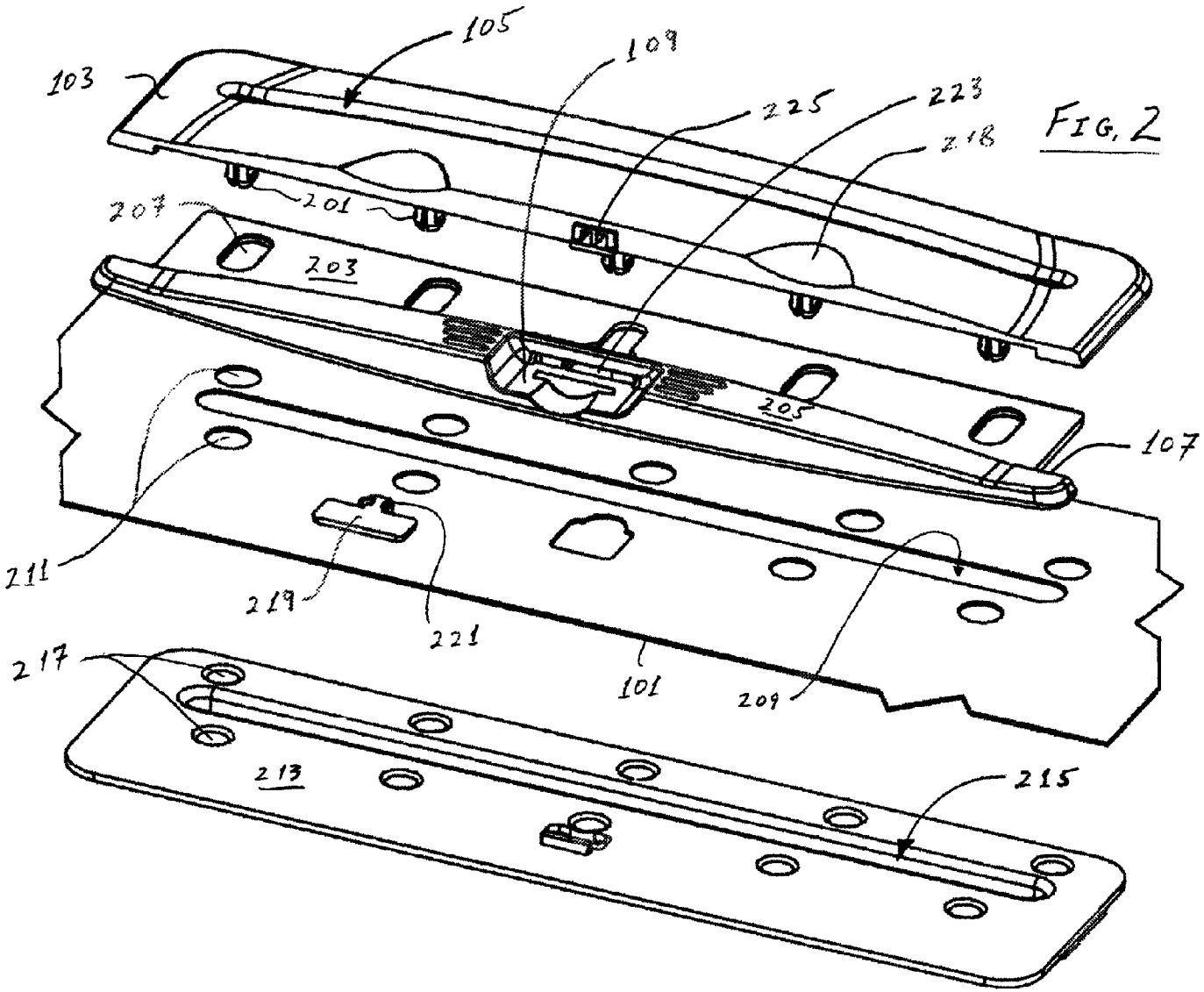
FIG. 2 is a partial top exploded perspective view of the device in FIG. 1.

FIG. 2 is an exploded perspective view of the device seen in FIG. 1. The frame 103 is preferably made of plastic or metal, and has a number of arms 201 depending from the frame and each includes a pawl at its distal end. The closure includes a flange 203 attached to the face 205 of the closure. The flange 203 includes a plurality of slide openings 207 through which corresponding arms 201 pass. Of course, depending arms without pawls can be used as guides for the slide openings. The slide openings are preferably oval, and functionally are of a geometry that allows the closure to be positioned effective to block and to unblock the slot 105 and/or slot 209. As shown, the extent of movement of the closure is determined by the relationship between the pawls and the extent of the slide openings in the direction generally orthogonal to the plane of the slot.

The frame and closure combination lies on the surface of the bag, which is provided, as mentioned above, with an opening 209 corresponding to the slot 105 in the frame. The bag surface is also provided with a plurality of receptacle openings 211 geometrically corresponding to (or registering with) the pawls in the frame. As shown, the frame includes two rows of pawls, one row proximal to the slot (from the viewer's perspective) and a second row distal to the slot. Of course, when assembled, the receptacle openings can be formed by the arms punching through the surface of the receptacle.

Disposed on the inside of the bag is a base frame 213 similarly having a slot opening 215 corresponding to the slot in the frame and the bag opening, and a series of catch holes 217 registering with the pawls. One or more of the catch holes can be a simple hole or channel that acts as a guide rather than a catch, and the frame and while the preferred embodiment has been described with respect to integrally formed pawls and catch holes, it will be appreciated that any method for securing the structure, including staples, rivets, bolts, and the like may be used.

As shown, the pawls attached to the frame pass through the openings in the closure and then those in the bag, and lock within the holes in the base frame, thereby creating the structure shown in FIG. 1. Because of the elongate geometry of the holes in the closure, the closure can be slid towards and away from the slot to prevent or to allow access to the inside of the bag, as desired.

When it is desired to seal the slot, the closure is moved towards the slot to form the arrangement as seen in FIG. 1, whereby the flange 203 closes the slot openings 105 in the frame and 209 in the bag. As shown, the frame preferably has finger depressions 218 to facilitate opening the closure. Complete removal of the closure is prevented because the construction shown locks the closure to the ballot device. A seal 219 is provided as a monolithic plate having one or more seal pawls 221, although any monolithic geometry can be used. The seal pawls 221 pass through a seal opening 223 provided in the closure and engage a seal catch 225 in the frame, thereby locking the closure to the frame and sealing the slot. Being made of plastic or metal, the seal (such as that described in the aforementioned GB-A 2,064,638 and GB-A 2,355,233 publications) must be broken, destroyed, or deformed in order to release the closure from the frame. Being made of metal or plastic, such seals are relatively inexpensive to make, and the plate can be manually broken away from the seal pawls to unlock the closure. With the slot as the only opening in the bag, such a bag is not reusable. The bag can be provided with a second locked and tamper evident closure, such as described in U.S. Pat. Nos. 3,759,073, 4,660,874, 4,661,990, and 5,013,162 (the disclosures of which are incorporated herein) to enable the ballots to be removed without damaging the bag, and then relocked so the bag can be reused. Preferably, the seal is tamper evident by having to be deformed, destroyed, or otherwise generally compromised to unseal. When used with a ballot box, such a box can be provided with a locked door to allow removal of the ballots and reuse of the box.

To further deter tampering, the plate portion of the seal preferably has permanent indicia thereon, such as by printing, imprinting, or embossing, or has permanently adhered on its surface a tamper evident film (such as a holographic film). The indicia may also be coloring, or color coding, of the seal material. By making the indicia unique or scarce (with respect to others of the same seal in general circulation, or at a given location), and optionally recording the seal and a bag identification (e.g., blue seal on bag number three), one who wants to tamper with the bag would need to have the same unique or scarce seal.

Figure 3E:
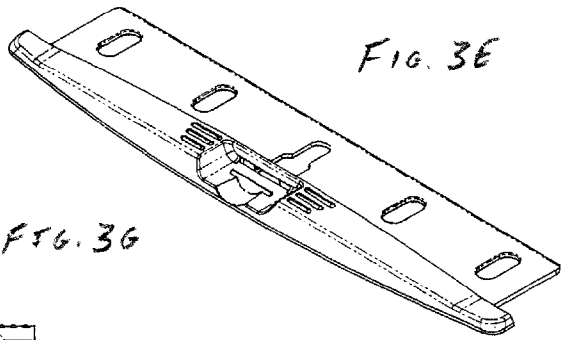
Figure 3F:
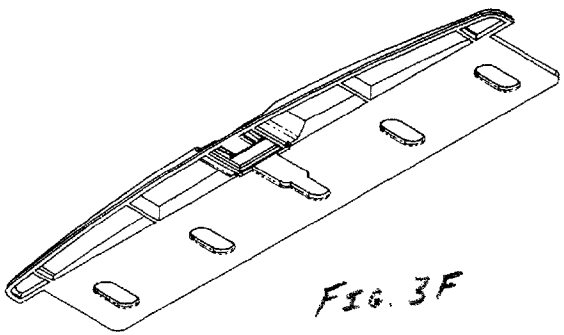
Figure 3G:
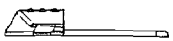
Figure 3A:
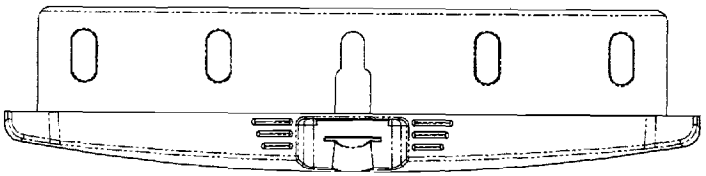
Figure 3B:
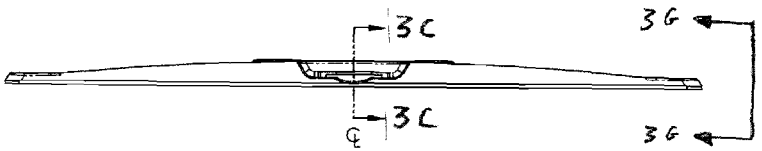
Figure 3D:
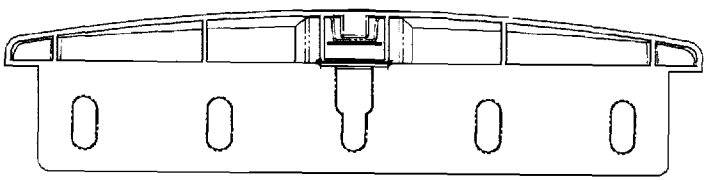
Figure 3C:
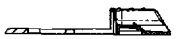

FIGS. 3A-G are self-evident with reference to FIGS. 1 and 2, with FIGS. 3A and 3E being a top and top perspective views of the frame, and FIGS. 3D and 3F being bottom and bottom perspective views.

Figures 4A, 4B, 4C, 4D, 4E, 4F, 4G:
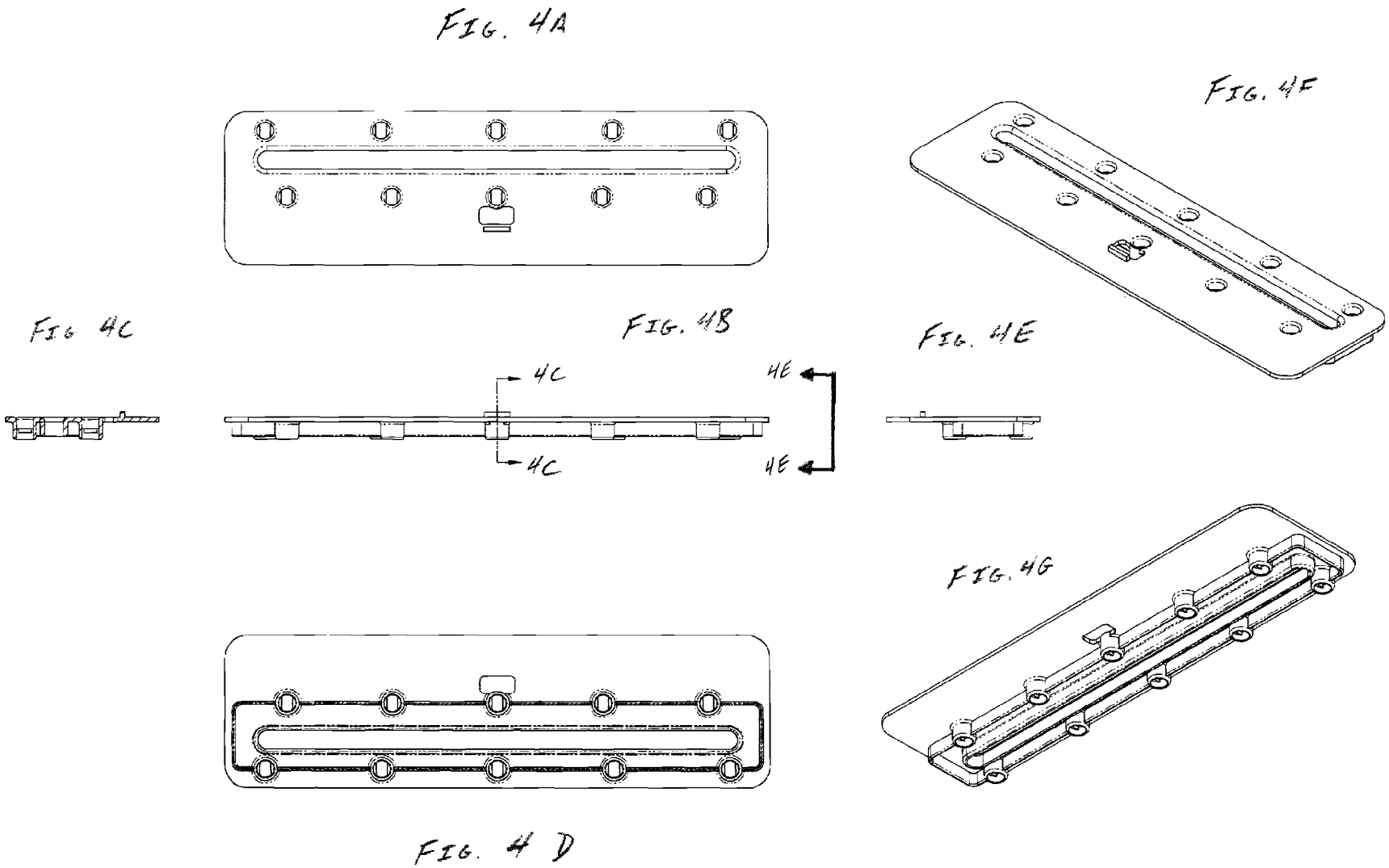

FIGS. 4A-G are self-evident with reference to FIGS. 1 and 2, with FIGS. 4A and 4F being a top and top perspective views of the frame, and FIGS. 4D and 4G being bottom and bottom perspective views.

FIGS. 5A-H are self-evident with reference to FIGS. 1 and 2, with FIGS. 5A and 5G being a top and top perspective views of the frame, and FIGS. 5F and 5H being bottom and bottom perspective views.

The invention also provides a kit including one or a set of locking ballot receptacles and one or a set of seals. Any of the seals may include printed or imprinted alpha, numeric, alphanumeric, and/or bar-coded identification. An optional logbook or software (e.g., database or spreadsheet type) can be included in the kit for recording desired details about the receptacle and identifying seal.

The foregoing description is meant to be illustrative and not limiting. Various changes, modifications, and additions may become apparent to the skilled artisan upon a perusal of this specification, and such are meant to be within the scope and spirit of the invention as defined by the claims.

What is claimed is:

1. A device for receiving ballots, comprising:

A. a receptacle having a surface defining an inside and an outside and having an opening of a predetermined geometry;

B. a base disposed inside the receptacle, having an opening corresponding to the geometry of the predetermined opening in the receptacle base;

C. a frame disposed outside the receptacle, having an opening corresponding to the geometry of the predetermined opening in the receptacle, having at least one depending arm, and having a seal catch; and D. a closure having a flange adapted for blocking at least one of said openings, said flange having a plurality of slide openings, said flange attached to a face having a recess with a seal opening allowing communication with said seal catch;

wherein said openings register so that a ballot inserted into the opening in the frame passes through the opening in the receptacle surface and the opening in the base to enter the inside of the receptacle, and at least one of the arms passes through at least one of the slide holes for slidable engagement between the closure and the frame in a direction generally orthogonal to the plane of the openings.

2. The device of claim 1, wherein said base further comprises a hole engaging the end of one of the depending arms.

3. The device of claim 2, wherein at least one arm is a pawl and the corresponding hole is a catch hole.

4. The device of claim 3, wherein said receptacle further comprises a preformed opening providing a passage for the arm to engage the hole.

5. The device of claim 2, wherein said receptacle further comprises a preformed opening providing passage of the arm to the hole.

6. The device of claim 1, wherein the frame has at least one finger depression.

7. The device of claim 1, wherein the receptacle is a bag.

8. The device of claim 1, further comprising a seal locking the closure to the frame, the seal passing through a seal opening in the closure and engaging the seal catch in the frame, and the flange obstructing the openings when the device is in a secured condition.

9. The device of claim 8, wherein the seal comprises a plate and a pawl that engages the seal catch.

10. The device of claim 9, wherein the seal evidences tampering.

11. The device of claim 10, wherein the seal must be compromised to unlock the closure from the frame.

12. A kit for collecting ballots, comprising

A. a ballot receptacle, comprising:

I. a receptacle having a surface defining an inside and an outside and having an opening of a predetermined geometry;

II. a base disposed inside the receptacle, having an opening corresponding to the geometry of the predetermined opening in the receptacle;

III. a frame disposed outside the receptacle, having an opening corresponding to the geometry of the predetermined opening in the receptacle, having at least one depending arm, and having a seal catch; and IV. a closure having a flange adapted for blocking at least one of said openings, said flange having a plurality of slide openings, said flange attached to a face having a recess with a seal opening allowing communication with said seal catch;

wherein said openings register so that a ballot inserted into the opening in the frame passes through the opening in the receptacle and the opening in the base to enter the inside of the receptacle, and at least one of the arms passes through at least one of the slide holes for slidable engagement between the closure and the frame in a direction generally orthogonal to the plane of the openings; and B. a plurality of seals locking the closure to the frame, the seal passing through a seal opening in the closure and engaging the seal catch in the frame, and the flange obstructing the openings when the device is in a secured condition.

13. The kit of claim 12, wherein said base further comprises a hole engaging the end of one of the depending arms.

14. The kit of claim 13, wherein at least one arm is a pawl and the corresponding hole is a catch hole.

15. The kit of claim 14, wherein said receptacle further comprises a preformed opening providing passage of the arm to the hole.

16. The kit of claim 14, wherein said receptacle further comprises a preformed opening providing a passage for the arm to engage the hole.

17. The kit of claim 12, wherein the frame has at least one finger depression.

18. The kit of claim 12, wherein the receptacle is a bag.

19. The kit of claim 12, wherein at least one of said plurality of seals comprises a plate and a pawl that engages the seal catch.

20. The kit of claim 12, wherein at least one of said plurality of seals evidences tampering.

21. The kit of claim 20, wherein the seal must be compromised to unlock the closure from the frame.

22. The kit of claim 21, further comprising a plurality of ballot receptacles.

23. The kit of claim 12, wherein at least two of said plurality of seals are visually distinguishable from each other.

24. The kit of claim 23, wherein each of said seals is uniquely distinguishable from the remaining seals.

25. The kit of claim 24, further comprising a plurality of ballot receptacles.

* * * * *